US005628202A

United States Patent [19]

Lee et al.

[11] Patent Number: 5,628,202

[45] Date of Patent: May 13, 1997

[54] COOLING POWER CONTROLLER FOR COMPRESSOR

[75] Inventors: Hyeong-Kook Lee; Kyeong-Bae Park, both of Seoul, Rep. of Korea

[73] Assignee: LG Electronics Inc., Rep. of Korea

[21] Appl. No.: 544,936

[22] Filed: Oct. 18, 1995

[30] Foreign Application Priority Data

Jun. 2, 1994 [KR] Rep. of Korea ..... 94.12782

[51] Int. Cl.[6] ..... F25B 1/00; G05B 5/00

[52] U.S. Cl. ..... 62/228.5; 318/471; 323/258; 417/45

[58] Field of Search ..... 62/6, 228.1, 228.5; 417/45, 212, 417; 323/258, 343; 318/471, 119

[56] References Cited

U.S. PATENT DOCUMENTS 3,931,554 1/1976 Spentzas ..... 417/417 X 4,714,870 12/1987 Nilsson ..... 323/258

5,156,005 10/1992 Redlich ..... 62/6

*Primary Examiner*—William E. Wayner

[57] ABSTRACT

In a compressor for adjusting a cooling power such that a piston integrally formed with an oscillator according to the oscillation of said oscillator adjusts the amount of refrigerant absorbed into a cylinder, a cooling power controller for the compressor which can control the cooling power by varying the power itself to change the operation state of the compressor for controlling the temperature of a refrigerator or an air conditioner, includes a power source for varying input alternate power to output the same through a plurality of secondary ports, an applied voltage controller for selecting the secondary port voltage of the power source to control the cooling power of the compressor, and a comparator for comparing a predetermined temperature with the actual temperature of an heat exchanger to control the applied voltage controller.

3 Claims, 2 Drawing Sheets

FIG 2

COOLING POWER CONTROLLER FOR COMPRESSOR

FIELD OF THE INVENTION

The present invention relates to a cooling power controller for a compressor, and more particularly, to a cooling power controller for a compressor which can control the cooling power while the compressor is continuously operative, by varying the power itself to change the operation state of the compressor for controlling the temperature of a refrigerator or an air conditioner, without switching power on or off.

BACKGROUND OF THE INVENTION

Conventionally, in order to change the operation state of the compressor for adjusting the temperature of a refrigerator or an air conditioner, since the speed of the compressor driven by a conductive motor is not change, the compressor should be driven by switching power on or off.

In other words, if a prescribed temperature is satisfied, the power is turned off to stop the compressor. After a predetermined time lapses so that the temperature deviates the prescribed temperature, the power is again turned on to operate the compressor so that the temperature becomes satisfiable. This is called a power on/off controlling method.

Also, there is another method of controlling the temperature of the compressor by changing the operative frequency thereof using an inverter, by which if a prescribed temperature is satisfied, the frequency is reduced to operate a compressor slowly. That is to say, if a detected temperature deviates from the predetermined temperature, the frequency is increased to operate the compressor fast so that the temperature is satisfied.

In this manner, the frequency is varied depending on the change of temperature around the prescribed temperature to control the operation of the compressor.

However, the conventional compressor controlling apparatus has the following problems.

First, in the power on/off controlling method, due to repeated drive and stop operation of the motor for driving the compressor, the life of the motor is shortened, and the temperature change is severe.

Next, the compressor controlling method using an inverter involves a problem in that the inverter is expensive, which leads to the cost rise of products.

SUMMARY OF THE INVENTION

It is an object of the present invention to provide a cooling power controlling apparatus for a compressor which can eliminate the noise of the compressor by driving the compressor by changing the voltage applied to a linear compressor for generating the cooling power.

To accomplish the above object, there is provide a cooling power controlling apparatus for a compressor comprising: a compressor for adjusting a cooling power such that a piston integrally formed with an oscillator according to the oscillation of the oscillator controls the amount of refrigerant absorbed into a cylinder; a power source for varying input alternate power to output the same through a plurality of secondary ports; an applied voltage controller for selecting the secondary port voltage of the power source to control the cooling power of the compressor; and a comparator for comparing a predetermined temperature with the actual temperature of an heat exchanger to control the applied voltage controller.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
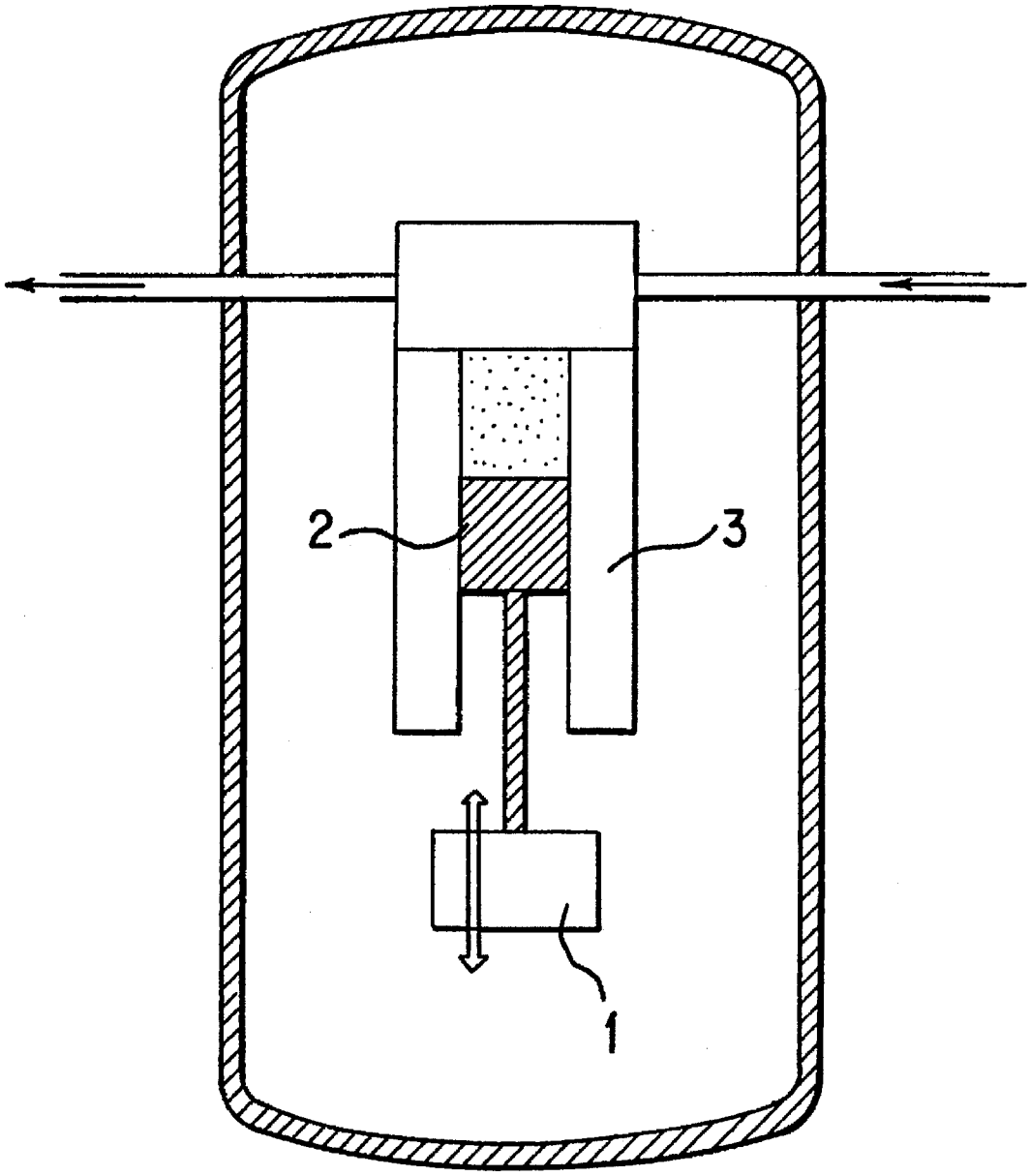
FIG. 1 is a schematic diagram of a linear compressor.

As shown, the apparatus includes a compressor 30 for adjusting the cooling power such that a piston 2 integrally formed with an oscillator 1 according to the oscillation of oscillator 1 controls the amount of refrigerant absorbed into a cylinder 3, a heat exchanger 40 for lowering the ambient temperature according to the cooling power of compressor 30, a power source 10 for varying input alternate power (60 Hz, 110/220 V) to output the same through a plurality of secondary ports, an applied voltage controller 20 for selecting the secondary port voltage of a transformer (T) of power source 10 to then adjust the cooling power of compressor 30, and a comparator for comparing a predetermined temperature with the actual temperature of heat exchanger 40, which is detected by a temperature sensor 50.

Here, applied voltage controller 20 includes a plurality of triode AC switches (triacs) (here, three) for switching the secondary output port voltages of transformer (T) according to the control of comparator 6, respectively, in power source 10.

The operation and effect of the present invention will now be described in detail with reference to the accompanying drawings.

As shown in FIG. 1, if oscillator 1 oscillates, piston 2 integrally formed with oscillator 1 oscillates in cylinder 3, accordingly. The oscillator variance "x" can be varied by adjusting applied voltages. In other words, the larger the voltage level is, the more the oscillator variance "x" becomes. Therefore, since the amount or the refrigerant absorbed into cylinder 3 is increased, the cooling power becomes larger. On the contrary, if the applied voltage is reduced, the variance "x" is decreased, which results in the reduction of refrigerant amount, thereby lowering the cooling power.

As described above, the linear compressor adjusts the cooling power by changing the applied voltage to adjust the temperature.

Figure 2:
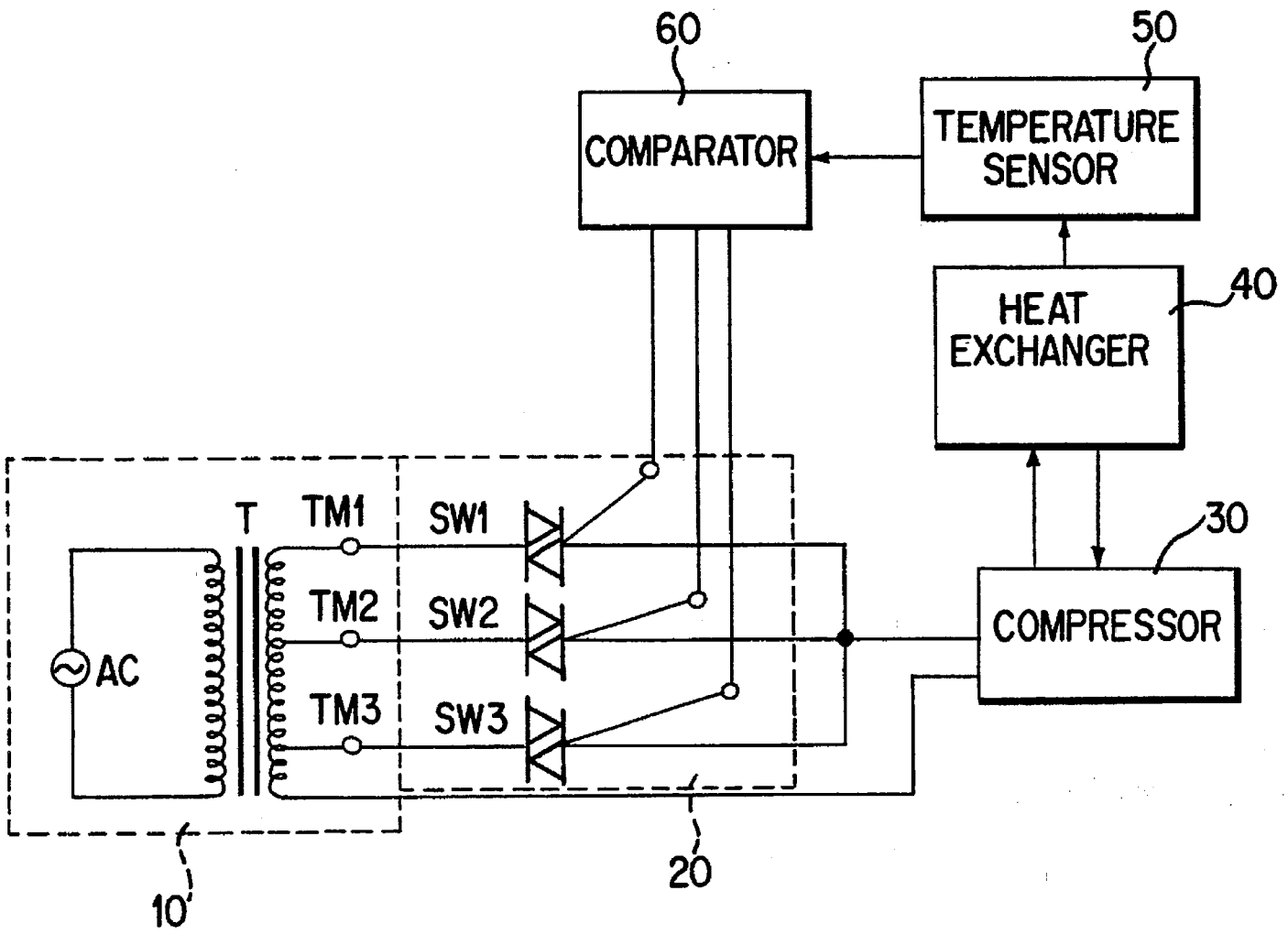
FIG. 2 is a schematic diagram of a cooling power controlling apparatus for a compressor according to the present invention.

Next, as shown in FIG. 2, a voltage is applied to compressor 30 through multistage output transformer (T) and applied voltage controller 20 for varying input AC power.

In other words, the secondary ports of transformer (T) are plural ports TM1, TM2 and TM3 and their output voltages are different from one another. Applied voltage controller 20 drives one of triacs SW1, SW2 and SW3 so as to be connected with one of secondary plural ports TM1, TM2 and TM3, thereby adjusting the voltage applied to compressor 30.

In order to detect the actual temperature of a refrigerator or an air conditioner, the temperature is detected by heat exchanger 40 using temperature sensor 50. The temperature detected by temperature sensor 50 and a prescribed temperature are compared by comparator 60. According to the comparison result, a triac of applied voltage controller 20 is selected to apply a voltage to a gate, thereby driving the triac.

In other words, if the actual temperature detected by temperature sensor 50 is lower than the prescribed temperature, triac SW1 is driven so as to be connected with a higher voltage port TM1 so that the cooling power is increased.

Also, if the actual temperature detected by temperature sensor 50 is higher than the prescribed temperature, triac SW3 is driven so as to be connected with a lower voltage port TM3 so that the cooling power is decreased.

As described above, a plurality of output ports installed in secondary port side of a transformer are controlled to vary voltages applied to the compressor, thereby eliminating the noise due repeated initiate and stop operations of the motor for driving the compressor. Accordingly, the life of the motor is prolonged, and a severe temperature change is prevented.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A cooling power controlling apparatus for a compressor for adjusting a cooling power such that a piston integrally formed with an oscillator according to the oscillation of said oscillator adjusts the amount of refrigerant absorbed into a cylinder, said apparatus comprising:

a heat exchanger connected to said compressor;

a transforming means for varying input A.C. power to output the same through a plurality of secondary taps;

applied voltage controlling means connected to said compressor for selecting the secondary tap voltage of said transforming means to adjust the cooling power of said compressor; and comparing means for comparing a predetermined temperature with the actual temperature of a heat exchanger to control said applied voltage controlling means.

2. The cooling power controlling apparatus for a compressor as claimed in claim 1, wherein said applied voltage controller includes a plurality of triode AC switches (triacs) for switching said secondary output tap voltages of said transforming means according to the control of said comparing means, respectively.

3. The cooling power controlling apparatus for a compressor as claimed in claim 2, wherein actual temperature is detected by said heat exchanger with a temperature sensor and the detected temperature is compared with a prescribed temperature by a comparator connected to said plurality of triode A.C. switches.

* * * * *